US007121545B2

(12) United States Patent
Baumgarten et al.

(10) Patent No.: US 7,121,545 B2
(45) Date of Patent: Oct. 17, 2006

(54) INDEPENDENTLY ACTIVATABLE SIDE PULL FOR LATERAL ALIGNMENT OF A SHEET

(75) Inventors: Sven Baumgarten, Heidelberg (DE); Jens Kloss, Eppelheim (DE); Michael Krueger, Edingen-Neckarhausen (DE); Juergen Maass, Wiesloch (DE); Volker Mueller, Leimen (DE); Thomas Schaeffer, Mauer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 54 days.

(21) Appl. No.: 10/422,459

(22) Filed: Apr. 24, 2003

(65) Prior Publication Data

US 2004/0065995 A1 Apr. 8, 2004

(30) Foreign Application Priority Data

Apr. 25, 2002 (DE) ..... 102 18 379

(51) Int. Cl.
*B65H 9/16* (2006.01)

(52) U.S. Cl. ..... 271/250

(58) Field of Classification Search ..... 271/227–228, 271/250–253

See application file for complete search history.

(56) References Cited

U.S. PATENT DOCUMENTS

| | | | | |
|---|---|---|---|---|
| 3,120,180 A | | 2/1964 | Black et al. | |
| 3,743,277 A | * | 7/1973 | Bolza-Schunemann et al. | 271/227 |
| 4,060,237 A | * | 11/1977 | Degen et al. | 271/231 |
| 4,164,349 A | * | 8/1979 | Marass | 271/250 |
| 4,184,673 A | * | 1/1980 | Weisbach | 271/237 |
| 4,188,027 A | * | 2/1980 | Naumann | 271/241 |
| 4,591,143 A | | 5/1986 | Jeschke | |
| 4,648,589 A | * | 3/1987 | Emrich et al. | 271/236 |
| 4,693,463 A | * | 9/1987 | Schwebel et al. | 271/236 |
| 5,322,012 A | | 6/1994 | Gartner et al. | |
| 5,820,123 A | * | 10/1998 | Gihr et al. | 271/236 |
| 6,364,311 B1 | * | 4/2002 | Merz et al. | 271/248 |
| 6,446,959 B1 | * | 9/2002 | Butterfass et al. | 271/226 |
| 6,454,256 B1 | | 9/2002 | Boguhn et al. | |

FOREIGN PATENT DOCUMENTS

| | | |
|---|---|---|
| DE | 1278449 | 9/1968 |
| DE | 3311197 | 10/1984 |
| DE | 4201886 | 7/1993 |
| DE | 19910688 | 9/2000 |

* cited by examiner

*Primary Examiner*—Gene O. Crawford
*Assistant Examiner*—Matthew J. Kohner
(74) *Attorney, Agent, or Firm*—Davidson, Davidson & Kappel, LLC

(57) ABSTRACT

A device and a method for lateral alignment of a sheet (5, 6) in a sheet processing machine, in which the sheet (5, 6) is movable essentially across its direction of transport (7) into an alignment position (4); a side pull lay device is used for moving the sheet (5, 6) into the alignment position (4). The side pull lay device has at least two side pull lays (1, 2) which are activatable independently of one another for transporting a sheet (5, 6) toward the alignment position (4). The method includes that at least two side pull lays (1, 2) of the side pull lay device are activated independently of one another for transporting a sheet (5, 6) toward the alignment position (4).

13 Claims, 3 Drawing Sheets

INDEPENDENTLY ACTIVATABLE SIDE PULL FOR LATERAL ALIGNMENT OF A SHEET

Priority to German Patent Application No. 102 18 379.1, filed Apr. 25, 2002 and hereby incorporated by reference herein, is claimed.

BACKGROUND INFORMATION

The present invention relates to a device for lateral alignment of a sheet in a sheet processing machine, in which the sheet is movable essentially across its direction of transport into an alignment position and the sheet is movable into the aligned position by a side pulling device.

Before a sheet can be processed in a printing press or a folding machine, it must be aligned to the machine inlet. Side pulling devices which convey the sheet to be processed against a side stop, whereby each sheet at the inlet of the machine assumes the same lateral position, are known to achieve this object. Such a side pulling device has, for example, a suction box which is movable across the direction of transport of the sheet, draws the sheet to be aligned by suction and then conveys it toward the side stop. German Patent Application No. 199 10 688 A1 describes a side pulling device which has two side stops and two pull bars to align the sheet to one of the stops both on the right and on the left. Also in this case suction is applied to the two pull bars, so that they can exert a holding force on the sheet to be aligned. Furthermore, the pull bars are each located in the side edge zone of the sheet to be aligned, in a feed table opposite one another below the transport level of the sheet. If the sheet is to be aligned to the right-hand stop, the right-hand pull bar is activated, and the sheet is moved to the right-hand stop. If the sheet is to be aligned to the left-hand stop, the left-hand pull bar is activated, and the sheet is moved to the left-hand stop. Thus, the sheet is handled and aligned by one or the other pull bar depending on whether it is to be aligned to the right or to the left. However, only the pull bar whose side has been selected manually is always active, i.e., all sheets are transported either to the right or to the left. This device for laterally aligning sheets has the disadvantage that only one pull bar is activated at any given time. Although there are two pull bars, one pull bar must do the entire alignment job by itself. The sheet is held fast using a single pull bar; therefore additional pressure rollers must be used to prevent the sheet to be aligned from fluttering to the side where it is not guided.

SUMMARY OF THE INVENTION

An object of the present invention is to provide a device and a method for laterally aligning a sheet which eliminate the disadvantages of the related art.

The present invention provides a device for lateral alignment of a sheet (5, 6) in a sheet processing machine, in which the sheet (5, 6) is movable essentially across its direction of transport (7) into an alignment position (4); a side pull lay device is used for moving the sheet (5, 6) into the alignment position; and the side pull lay device has at least two side pull lays (1, 2) which are activatable independently of one another for transporting a sheet (5, 6) toward the alignment position (4). When the sheet (5) to be aligned is to the left of the alignment position (4), the right-hand side pull lay (1) is assigned a pulling function and, conversely, when the sheet (6) to be aligned is to the right of the alignment position (4), the left-hand side pull lay (2) is assigned a pulling function. Also provided is a method of lateral alignment of a sheet (5, 6) in a sheet processing machine, wherein, when the sheet (5) to be aligned is to the left of the alignment position (4), the right-hand side pull lay (1) pulls the sheet (5) toward the alignment position (4) and, conversely, when the sheet (6) to be aligned is to the right of the alignment position (4), the left-hand side pull lay (2) pulls the sheet toward the alignment position (4).

The device according to the present invention and the method according to the present invention make it possible to align the sheet either to the left or to the right as in the related art. However, it is also possible to move the sheet to an alignment position which is located between the right-hand and left-hand side stop, i.e., the lateral guidance limits of the sheet. To make this more understandable, the alignment method is described below in detail. When a sheet enters a sheet processing machine, the sheet has a certain lateral distance to a right-hand or a left-hand limit across its direction of transport. The sheet feed at the inlet of the machine is configured so that the sheet always comes to rest between the right-hand and left-hand limit. In the related art, the sheet is always aligned either to the right-hand or to the left-hand limit. The device and the method according to the present invention make it possible to align the sheet to a virtual limit which is located between the right-hand and the left-hand limits and will be referred to hereinafter as the alignment position. This means that the sheet in the alignment position has a spacing to both right-hand and left-hand limits. If the sheet enters the machine left of the alignment position, at least one right-hand side pull lay is actuated, which pulls the sheet to the right until it comes to rest exactly in the virtual alignment position. However, if the sheet enters the machine right of the alignment position, at least one side pull lay is activated, which moves the sheet to the left to the alignment position. The device and the method also allow one or the other side pull lay to be activated, depending on the inlet position of the sheet. In addition, it is also possible to activate both side pull lays simultaneously, so that one side pull lay pulls the sheet toward the alignment position, while the other side pull lay pushes the sheet toward the alignment position. Thus, the present invention also makes it possible to use both side pull lays for the joint transport of a sheet, whereby the sheet is guided on both sides and fluttering is largely prevented, while in the related art pressure rollers are used in addition to the side pull lays to prevent the sheet from fluttering.

A further advantage is that the side pull lays are activated using a position sensor and a control device, so that the process runs automatically, the control device activating the side pull lays according to the signal of the position sensor.

In one embodiment of the present invention, the alignment position of the sheets to be aligned laterally is essentially in the center of the longest alignment path. This offers the considerable advantage that the longest alignment path is not longer than one-half of the distance between the right-hand and left-hand limits of the sheet transport path into the machine. Even when the sheet enters the machine on the extreme left side or the extreme right side, the alignment path cannot be longer than one-half of the distance between the sheet and the left-hand or right-hand limit. In contrast, if the sheet is aligned to the right-hand or left-hand limit, in the most unfavorable case, e.g., when the sheet enters the machine on the extreme left side and is aligned to the right, a transport path which is twice as long may be required.

A further advantage results from the fact that a position sensor is used, which is positioned and designed so that it is able to determine the deviation of the sheet to be aligned from the alignment position. In this case, only one position sensor is used, which covers the entire width of the longest alignment path, so that a sheet entering the machine always covers the position sensor. It is thus ensured that a sheet is reliably recognizable by a single sensor as it enters the machine. Using the deviation from the alignment position that has been determined, which the position sensor transmits to the control device of the machine, it may be determined at the same time whether the sheet is entering the machine to the right or to the left of the alignment position and how far from the alignment position it is.

In a further embodiment of the present invention, when the sheet to be aligned is to the left of the alignment position, the right-hand pull lay has a pulling function and the left-hand side pull lay has a pushing function and, conversely, when the sheet to be aligned is to the right of the alignment position, the left-hand pull lay has a pulling function and the right-hand pull lay has a pushing function. This embodiment of the present invention offers the advantage that the sheet to be aligned is guided by both right-hand and left-hand side pull lays. Depending on the direction in which the sheet is transported into the alignment position, it is pulled by one pull lay and pushed by the other pull lay. In both cases, the sheet is thus guided on both sides, which prevents it from fluttering.

The side pull lay which is assigned the pulling function when aligning the sheet advantageously has a higher operating speed than the side pull lay which is assigned the pushing function. In this way the sheet to be aligned may be tautened and smoothed by the side pull lay. Of course, it must be made sure that the forces tautening and smoothing the sheet do not reach the point of tearing the sheet.

A further advantage results from the fact that in a further embodiment a greater attraction force exists between the side pull lay which is assigned the pulling function in aligning the sheet and the sheet to be aligned than between the sheet and the side pull lay which is assigned the pushing function. Such an embodiment ensures that the sheet on the pulling side pull lay does not slip, so that optimum alignment to the alignment position is always ensured. If slippage occurs between the sheet and one side pull lay, it is thus ensured that the slippage occurs between the sheet and the pushing side pull lay. This slippage between the pushing side pull lay and the sheet also permits the sheet to be gently smoothed, since the slippage between the sheet and the pushing side pull lay is controllable so that tearing or overstretching the sheet is ruled out in that the tensile forces acting on the sheet may be limited by the slippage between the pushing side pull lay and the sheet.

In a further embodiment of the present invention, at least one movable side stop is advantageously used. The alignment of the sheet to the alignment position requires a very accurately controlled sequence of movements in aligning the sheet, since the sheet is only aligned to the alignment position accurately if the sheet has a velocity component across the direction of transport which tends to zero as the sheet reaches the alignment position. To ensure this, an additional movable side stop may be provided.

In a further embodiment of the present invention, at least two movable side stops are used, the right-hand movable side stop being movable into an auxiliary alignment position when the sheet to be aligned is movable to the right toward the alignment position and, vice versa, the left-hand side stop being movable into the alignment position when the sheet to be laterally aligned is movable to the left toward the alignment position. Of course, the auxiliary alignment position and the alignment position may be switched around depending on whether the sheets are to be aligned with their right-hand or left-hand sides. In the exemplary embodiments of the present invention, it is assumed that each sheet is aligned to the alignment position with its left-hand edge, the right-hand edge of the sheet being optionally aligned to the auxiliary alignment position. The auxiliary alignment position depends on the sheet width, which represents the distance between the left and right sheet edges. If narrower or wider sheets are to be aligned, the auxiliary alignment position must be adjusted to the modified sheet width. The use of movable side stops offers the advantage that sheets to be aligned are reliably aligned to the alignment position even if the sheets have a minimum non-zero velocity component across the direction of transport as they reach the alignment position. If the sheet is moved to the right toward the alignment position, the right-hand side stop is brought into a specific auxiliary alignment position which depends on the sheet width, so that the right-hand edge of the sheet strikes the auxiliary alignment position as the sheet reaches the alignment position. Conversely, if the sheet is brought into the alignment position to the left, the left-hand side stop is brought into the alignment position, so that the left-hand edge of the sheet to be aligned strikes the stop. The unneeded side stop is folded away laterally, upward, or downward, so that it does not impede, or touch, the sheet to be aligned.

The side pull lays advantageously have openings for producing a partial vacuum or excess pressure between the side pull lays and the sheets. The sheet to be aligned may be attached to the side pull lays by partial vacuum using the opening, so that reliable transport of the sheet by the side pull lays is possible. To facilitate detachment of the sheet from the side pull lays, the partial vacuum operation may be switched over to excess pressure operation, so that a gentle blow through the openings reliably detaches the sheet from the side pull lay. Partial vacuum and excess pressure are advantageously produced by a device which is able to either attach the sheet to the side pull lays by suction or detach it by a gentle blow through the openings.

In a further advantageous embodiment of the present invention, the side pull lays are activatable so that the sheet has almost a velocity component $v_z=0$ across the direction of transport upon reaching the alignment position. The side pull lays are activated using the position sensor, regulators, or characteristic curves stored in the controller of the side pull lay device, so that the sheet no longer moves across the direction of transport as it reaches the alignment position. This is important if there are no movable side stops. The omission of movable side stops eliminates the possibility of damaging the sheet to be aligned by undulations or bends when it strikes the stops, and the sheet is gently placed in the alignment position.

BRIEF DESCRIPTION OF THE DRAWINGS

Exemplary embodiments of the present invention are described in detail and explained below with reference to the drawings, in which.

DETAILED DESCRIPTION

Figure 1:
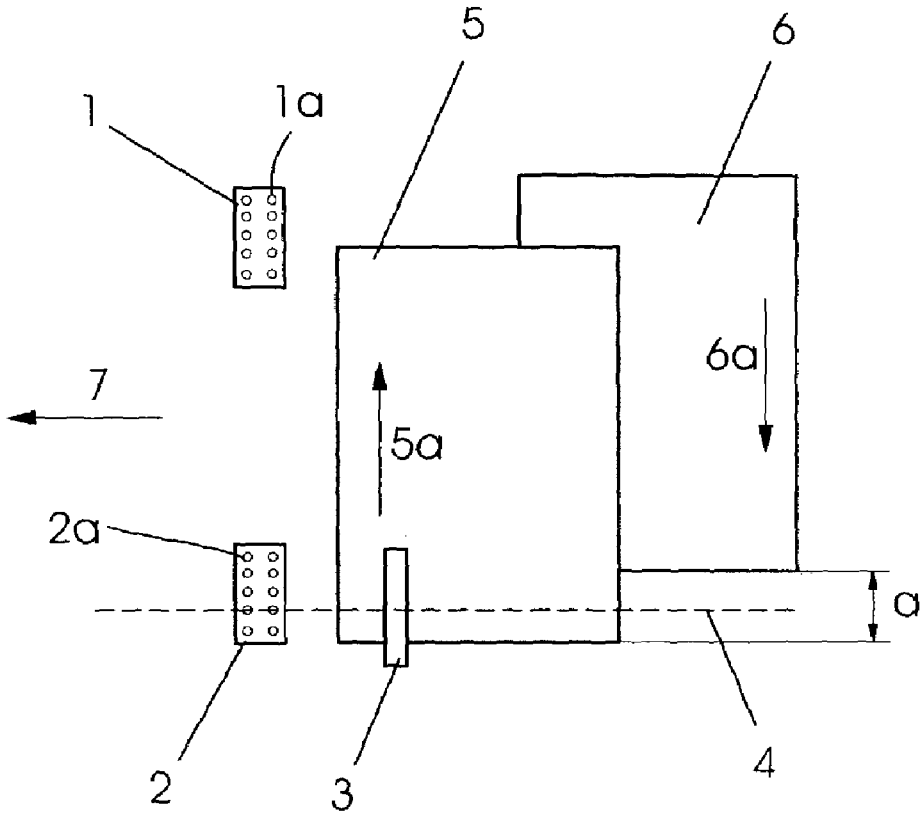
FIG. 1 shows a side pull lay device for aligning a sheet to an alignment position located in the center of the longest alignment path.

FIG. 1 shows a side pull lay device according to the present invention, which is installed in a paper processing machine. The side pull lay device may be installed, for example, in the feed mechanism upstream from the first printing unit of a printing press, but it may also be installed in a folding machine. The side pull lay device is normally used for aligning either the left or the right edge of sheets 5, 6 (viewed with arrow 7 pointing upwardly in FIG. 1) entering a paper processing machine with respect to a predefined position. Sheets 5, 6 are taken from a sheet stack by a gripping device and transported to the side pull lay device. The direction of movement of sheets 5, 6 through the side pull lay is referred to as direction of transport 7. The predefined position, to which sheets 5, 6 entering the side pull lay device are aligned, is shown in FIG. 1 using dashed line 4 and is referred to as alignment position 4. Alignment position 4 is here a "virtual" side pull lay, since it is neither delimited by a stop nor needs to be marked otherwise on the platform of the side pull lay device. Alignment position 4 is only stored in the form of coordinates in a control device 11 of the side pull lay device. This means that alignment position 4 is easily modifiable by an operator inputting modified coordinates in control device 11.

Sheet 5, 6 taken from the feed stack enters the side pull lay device in a certain position, the maximum difference representing alignment path a which is delimited by the dimensions in the paper processing machine. In FIG. 1, sheet 5 represents the position in which it enters the side pull lay device at the extreme left edge, while sheet 6 represents the position in which it enters the side pull lay device at the extreme right edge. In the exemplary embodiment of FIG. 1, sheets 5, 6 are each to be aligned to alignment position 4 at their left-hand edge viewed in the direction of transport 7. Sheets 5, 6 are aligned to alignment position 4 using side pull lays 1 and 2, which are movable essentially across, i.e. perpendicular to, direction of transport 7. In the simplest embodiment, side pull lays 1, 2 only move across direction of transport 7, being able to move either to the left or to the right. For this purpose, side pull lays 1, 2 are set in motion via electrically operated drives (not shown in FIG. 1).

Before sheets 5, 6 to be aligned reach side pull lays 1, 2 viewed in direction of transport 7, they pass a position sensor 3. The position of sheet 5, 6 is generally not detected by the sensor until sheet 5, 6 covers side pull lays 1, 2. It is thus ensured that the position of sheet 5, 6, from which it is subsequently laterally displaced, is correctly detected. Position sensor 3 is designed here such that it always detects the left edge of a sheet 5, 6 to be aligned whether sheet 5 is at the extreme left edge or sheet 6 is at the extreme right edge. The deviation of sheet 5, 6 to be aligned from alignment position 4, which here is in the center of alignment path a, is thus to be determined by position sensor 3 and processed in control device 11 of the side pull lay device. If sheet 5 is to the left of alignment position 4, right-hand side pull lay 1 is always switched to the operating mode "pull sheet to the right," whereupon right-hand side pull lay 1 moves sheet 5 to the right until the left-hand edge of sheet 5 reaches alignment position 4. Conversely, if sheet 6 to be aligned is to the right of alignment position 4, left-hand side pull lay 2 is always switched to the operating mode "sheet transport to the left," whereupon the sheet is pulled to the left until the left-hand edge of the sheet reaches alignment position 4. The particular side pull lay 1, 2 is activated by control device 11 so that, when sheet 5, 6 to be aligned has reached alignment position 4, the velocity to the right in pulling direction 5*a* across direction of transport 7 or to the left in pulling direction 6*a* across direction of transport 7 no longer has any velocity component $v_z$ in the pulling direction, i.e., across direction of transport 7. It is thus ensured that sheet 5, 6 is precisely aligned to alignment position 4. The velocity of sheet 5, 6 may still have a residual component $v_t$ in direction of transport 7, as long as sheet 5, 6 no longer changes its lateral position.

In order for side pull lays 1, 2 to be able to move sheet 5, 6 to be aligned, they have openings 1*a*, 2*a*, through which a partial vacuum is produced between sheet 5, 6 and side pull lay 1, 2, which in turn ensures that sheet 5, 6 adheres to side pull lay 1, 2. If sheet 5, 6 has reached alignment position 4, the partial vacuum is switched off and thus sheet 5, 6 is detached from side pull lay 1, 2. In order to facilitate the detachment of sheet 5, 6 from side pull lay 1, 2, air may be gently blown onto the sheet through openings 1*a*, 2*a*. A device capable of producing both a partial vacuum and an excess pressure between side pull lays 1, 2 and sheet 5, 6 via openings 1*a*, 2*a* is used for this purpose. This is advantageously an electrically operated air pump, which may run either as a compressor in excess pressure mode or as a vacuum pump in partial vacuum mode. It is furthermore possible that sheet 5, 6 is brought into alignment position 4 not only by one side pull lay 1, 2, but one side pull lay 1, 2 pulls sheet 5, 6, while the other side pull lay 1, 2 pushes the sheet. If sheet 5 needs to be moved to the right to alignment position 4, right-hand side pull lay 1 operates as a pull lay, while left-hand side pull lay 2 operates as a push lay. In addition, it is possible to select a somewhat lower operating speed in pulling direction 5*a* for the push lay, in this case left-hand side pull lay 2, so that sheet 5 is held taut and smooth during the alignment. In order not to overstress sheet 5, it is also possible to attach it with suction to pushing side pull lay 2 using a lower partial vacuum than with pulling right-hand side pull lay 1. This causes sheet 5 to adhere firmly to right-hand side pull lay 1, while a certain slippage occurs between sheet 5 and left-hand side pull lay 2. Sheet 5 is also smoothed in this way, while it is prevented from slipping on pulling right-hand side pull lay 1 and thus being imprecisely aligned to alignment position 4. It is also ensured in this way that control device 11 is able to determine the position of sheet 5 from the position of the pull lay, in this case side pull lay 1, since sheet 5 is carried firmly adhering to the pull lay. Of course, pull and push lays are switched around when sheet 6 is moved in pulling direction 6*a* to the left to alignment position 4. It is also possible to switch off the vacuum of the push lay before alignment position 4 is reached, so that only the pull lay carries sheet 5, 6 on the last stretch of the pull path.

Figure 2:
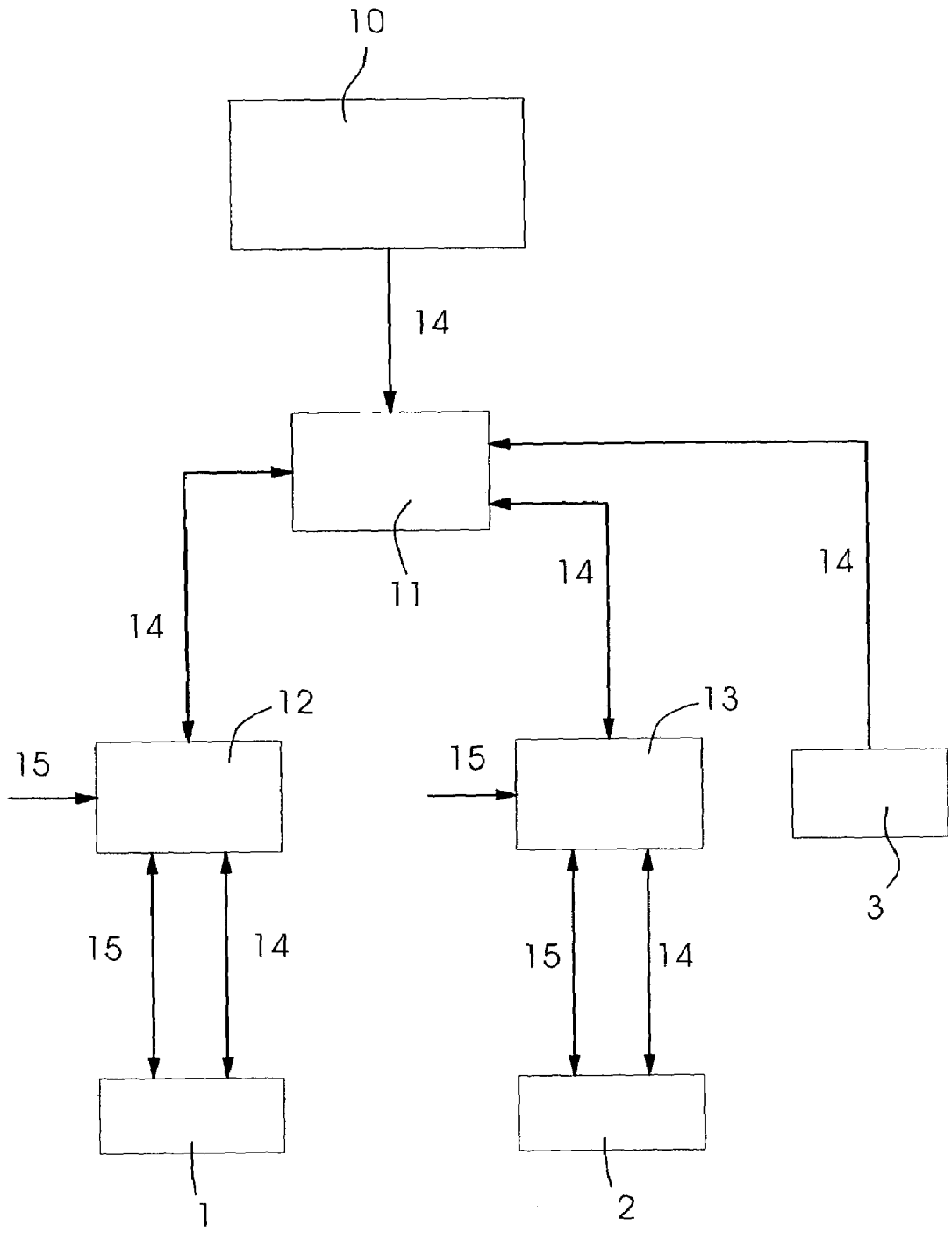
FIG. 2 shows a block diagram of the control and power supply components of a side pull lay device according to the present invention.

FIG. 2 shows a block diagram of the essential electric components of a side pull lay device according to the present invention. The core component of the side pull lay device is control device 11 of the side pull lay device. Control device 11 controls the sequence of movements of left-hand side pull lay 2 and right-hand side pull lay 1. Furthermore, control device 11 communicates with a higher-level machine controller 10, which represents the machine control of a printing press or a folding machine, for example. For this purpose, control device 11 receives input signals 14 of position sensor 3 and power components 12, 13 of side pull lays 1, 2. Power components 12, 13 are used for supplying power to the drive motors of side pull lays 1, 2 as a function of the control commands of control device 11. Control device 11 receives, via signal 14 of position sensor 3, the inlet position and the position of a sheet 5, 6, during the alignment process, while signals 14 of power components 12, 13 transmit the actual position of the particular side pull lay 1, 2 to control device 11. Furthermore, control device 11 receives signals 14 of higher-level machine controller 10. Signals 14 containing the setpoint values for the alignment sequence of a sheet 5, 6 to alignment position 4 are transmitted to power components 12, 13 via outputs of control device 11. Power components 12, 13 in turn set the current or voltage of the particular side pull lay 1, 2 according to the setpoint values transmitted, so that the setpoint position of side pull lays 1, 2 is reached. In addition, power components 12, 13 exchange signals 14 with side pull lays 1, 2 to be able to determine the actual position of side pull lays 1, 2. Power components 12, 13 are also connected to an electrical power supply 15, e.g., the power supply network, and thus supply power to the drive motors of side pull lays 1, 2.

Figure 3:
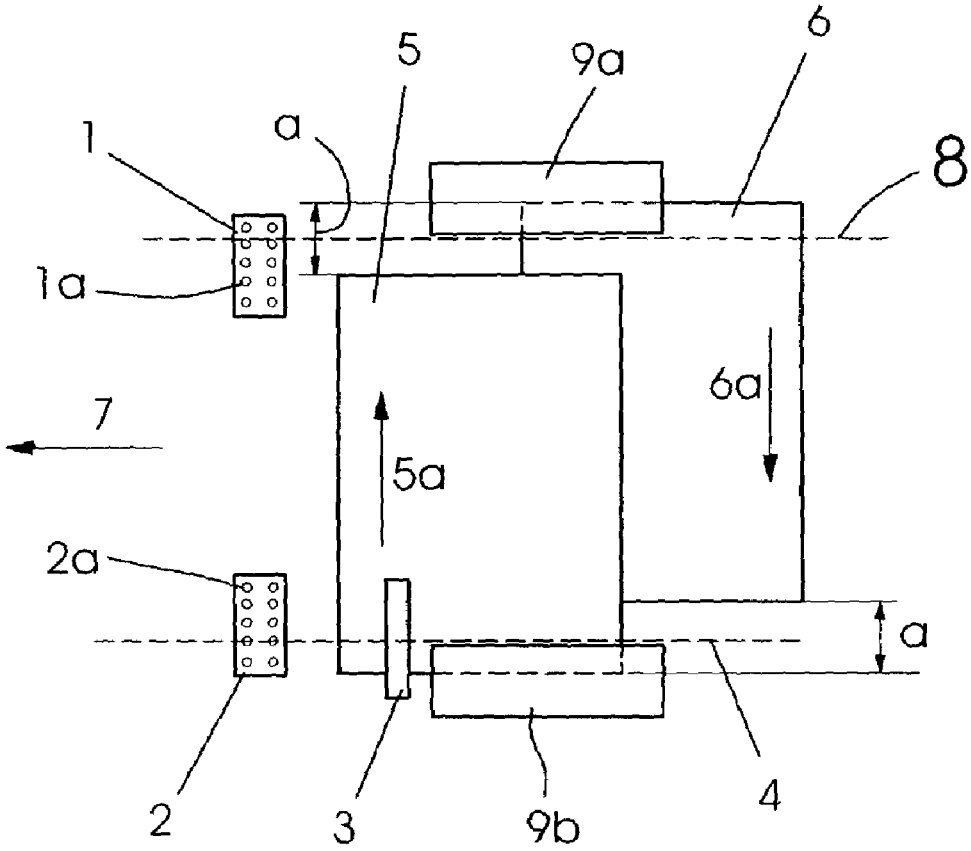
FIG. 3 shows a side pull lay device having additional movable side stops.

The embodiment shown in FIG. 3 is based on the embodiment illustrated in FIG. 1, which here has two additional movable side stops 9*a*, 9*b*. Furthermore, another virtual side pull lay 8, referred to as auxiliary alignment position 8, is indicated in FIG. 3 by dashed lines. Right-hand movable side stop 9*a* is designed so that it is exactly in auxiliary alignment position 8 when it is in the stop position. In contrast, left-hand movable side stop 9*b* is designed so that it is exactly in alignment position 4 when it is in the stop position. Movable side stops 9*a*, 9*b* are used to assist side pull lays 1, 2 in correctly positioning sheet 5, 6 in alignment position 4.

If a sheet 5 enters the side pull lay device to the left of alignment position 4, right-hand movable side stop 9*a* is brought into the stop position, so that, when the left-hand edge of sheet 5 has reached alignment position 4, the right-hand edge of sheet 5 rests on right-hand side stop 9*a*. Conversely, if sheet 6 enters the side pull lay device to the right of alignment position 4, left-hand movable side stop 9*b* is brought into the top position, so that sheet 6 strikes left-hand side stop 9*b* when it has reached alignment position 4. For this purpose, movable side stops 9*a*, 9*b* have a foldable or rotatable design, so that only stop 9*a* or 9*b* may touch sheet 5, 6 depending on which side stop 9*a*, 9*b* is needed at the time. For this purpose, side stops 9*a*, 9*b* have electrical drives (not shown) capable of moving them into the stop position. The electrical drives are activated by control device 11 for this purpose, i.e., control device 11 coordinates and controls all movement sequences of side pull lay 1, 2 and movable side stops 9*a*, 9*b*. As an alternative, movable side stops 9*a*, 9*b* may also be moved pneumatically or hydraulically into the stop position, with additional drive types also being conceivable.

It must be ensured that at least one of side stops 9*a*, 9*b* is also adjustable in its position across direction of transport 7 if it is possible that sheets 5, 6 have different widths. In the exemplary embodiment according to FIG. 3, alignment position 4 is established as a fixed alignment position and therefore as a reference point; therefore, in this case the position of right-hand movable side stop 9*a* must be variable across direction of transport 7. Of course, if alignment position 4 and auxiliary alignment position 8 are switched around, the position of left-hand side stop 9*b* must be variable.

U.S. Pat. No. 6,302,021, hereby incorporated by reference herein, for example, shows a sheet-fed printing press in which the device fo the present invention may be used.

LIST OF REFERENCE SYMBOLS

| | |
|---|---|
| 1 | right-hand side pull lay |
| 1a | openings in the right-hand side pull lay |
| 2 | left-hand side pull lay |
| 2a | openings in the left-hand side pull lay |
| 3 | position sensor |
| 4 | alignment position |
| 5 | sheet to the left of the alignment position |
| 5a | pulling direction to the right across the direction of transport |
| 6 | sheet to the right of the alignment position |
| 6a | pulling direction to the left across the direction of transport |
| 7 | direction of transport |
| 8 | auxiliary alignment position |
| 9a | right-hand movable side stop |
| 9b | left-hand movable side stop |
| 10 | machine control |
| 11 | control device of the side pull lay device |
| 12 | power component of the right-hand side pull lay |
| 13 | power component of the left-hand side pull lay |
| 14 | signals |
| 15 | electric power supply |
| a | alignment path |
| $v_t$ | velocity in the direction of transport |
| $v_z$ | velocity in the pulling direction to the right or left across the direction of transport |

What is claimed is:

1. A device for lateral alignment of a sheet in a sheet processing machine, the sheet being movable across a direction of transport into an alignment position, the device comprising:

a side pull lay device for moving the sheet into the alignment position, the sheet being able to enter the lateral alignment device on both sides of the alignment position so as to define an inlet position, the side pull lay device having at least a right-hand side pull lay and a left-hand side pull lay activatable independently of the right hand side pull lay, the side lay pull device for transporting a sheet toward the alignment position, and a control device controlling the side pull lay device depending on the inlet position of the sheet with respect to the alignment position so when the sheet to be aligned is to the left of the alignment position, the right-hand side pull lay is assigned a pulling function and, conversely, when the sheet to be aligned is to the right of the alignment position, the left-hand side pull lay is assigned a pulling function.

2. The device as recited in claim 1 wherein the alignment position of the sheets to be aligned laterally is in a center of a longest alignment path.

3. The device as recited in claim 1 wherein, when the sheet to be aligned is to the left of the alignment position, the left-hand side pull lay is assigned a pushing function and, conversely, when the sheet to be aligned is to the right of the alignment position, the right-hand side pull lay is assigned a pushing function.

4. The device as recited in claim 1 further comprising only a single position sensor positioned so that deviation of the sheet from the alignment position is determinable.

5. The device as recited in claim 1 further comprising at least one movable side stop.

6. The device as recited in claim 1 further comprising at least a right-hand movable side stop and a left-hand moveable side stop, the right-hand movable side stop being movable into an auxiliary alignment position when the sheet to be aligned is movable to the right toward the alignment position and, vice versa, the left-hand side stop being movable into the alignment position when the sheet to be laterally aligned is movable to the left toward the alignment position.

7. The device as recited in claim 1 wherein the right-hand and left-hand side pull lays are activatable so that the sheet approaches a velocity component equal to zero across the direction of transport upon reaching the alignment position.

8. A printing press having a device as recited in claim 1.

9. A folding machine having a device as recited in claim 1.

10. A method of lateral alignment of a sheet in a sheet processing machine, the sheet being movable across its direction of transport into an alignment position by a side pull lay device; the sheet being able to enter on both sides of the alignment position so as to define an inlet position and at least a right-hand side pull lay and a left-hand side pull lay of the side pull lay device being activatable independently of one another for transporting the sheet toward the alignment position, the method comprising the steps of:

depending on the inlet position of the sheet with respect to the alignment position pulling the sheet toward the alignment position using the right-hand side pull lay when the sheet to be aligned is to the left of the alignment position and, conversely, pulling the sheet toward the alignment position using the left-hand side pull lay when the sheet to be aligned is to the right of the alignment position.

11. The method as recited in claim 10 further comprising pushing the sheet toward the alignment position using the left-hand side pull lay when the sheet to be aligned is to the left of the alignment position, and, conversely, pushing the sheet toward the alignment position using the right-hand side pull lay when the sheet to be aligned is to the right of the alignment position.

12. The method as recited in claim 10 further comprising moving a right-hand movable side stop into an auxiliary alignment position when the sheet to be aligned is moved to the right toward the alignment position and, vice versa, moving a left-hand movable side stop into the alignment position when the sheet to be laterally aligned is moved to the left toward the alignment position.

13. The method as recited in claim 10 wherein the alignment position of the sheets to be aligned laterally is in a center of a longest alignment path.

* * * * *